United States Patent [19]

Gibson-Saxty

[11] Patent Number: 4,969,761

[45] Date of Patent: Nov. 13, 1990

[54] APPARATUS AND METHOD FOR CONTROLLING PRINT RIBBON FEED

[75] Inventor: Stephen J. Gibson-Saxty, Norman, Okla.

[73] Assignee: BancTec, Inc., Dallas, Tex.

[21] Appl. No.: 471,541

[22] Filed: Jan. 29, 1990

[51] Int. Cl.[5] ..... B41J 33/14

[52] U.S. Cl. ..... 400/225; 400/232; 242/75.51; 242/DIG. 1; 242/67.5

[58] Field of Search ..... 400/225, 223, 232, 208; 364/565, 566; 242/75.5, 75.51, DIG. 1, 67.5

[56] References Cited

U.S. PATENT DOCUMENTS

| | | | |
|---|---|---|---|
| 4,177,731 | 12/1979 | Kliest et al. | 400/219.1 |
| 4,475,829 | 10/1984 | Goff, Jr. et al. | 400/232 |
| 4,558,965 | 12/1985 | Ueda et al. | 400/208 |
| 4,647,238 | 3/1987 | Ouamoto et al. | 400/225 |
| 4,728,206 | 3/1988 | Mori et al. | 400/225 |
| 4,787,763 | 11/1988 | Kondo | 400/208 |
| 4,878,773 | 11/1989 | Mazumder | 400/223 |

FOREIGN PATENT DOCUMENTS

| | | | |
|---|---|---|---|
| 0063472 | 4/1986 | Japan | 400/225 |
| 0199972 | 9/1986 | Japan | 400/225 |
| 0016176 | 1/1987 | Japan | 400/225 |
| 1416295 | 12/1975 | United Kingdom | 400/225 |

OTHER PUBLICATIONS

"Stepper Motor Angular Velocity Detection Circuit", IBM Tech. Discl. Bull., vol. 32 No. 613, Nov. 89, pp. 426–427.

"Regulated Speed Ribbon Drive", IBM Tech. Discl. Bull., vol. 23, No. 11, 4/81, pp. 4891–4895.

*Primary Examiner*—Eugene H. Eickholt
*Attorney, Agent, or Firm*—Kenneth R. Glaser

[57] ABSTRACT

A printing system includes print ribbon wound on first and second rotatable reels and a rotatable capstan for moving the ribbon between the first and second reels, such that ribbon is supplied from the first reel and is collected after use on the second reel. A microprocessor controls both the reel and capstan movements and computes the quantity of ribbon wound on each reel based on a known diameter of the capstan and the relationship between the number of rotational steps moved by the capstan and the number of rotational steps moved by the corresponding reel during a given time period. The microprocessor includes a random access memory in which a plurality of ramp tables are stored for controlling the movements of the reels. Each ramp table includes a speed parameter representing a particular rotational speed and an acceleration parameter representing a number of rotational steps for ramping up to and down from the particular speed, for a discrete range of ribbon diameters. The diameter of ribbon wound on each reel is determined periodically by comparing the number of steps moved by the corresponding reel to a plurality of reference values representing respective predetermined ribbon diameters, to determine the particular discrete range of ribbon diameters applicable to each reel. The particular discrete range of ribbon diameters determines the particular ramp table used to control the movements of the corresponding reel.

21 Claims, 4 Drawing Sheets

APPARATUS AND METHOD FOR CONTROLLING PRINT RIBBON FEED

Field of the Invention

This invention relates generally to printing systems and in particular to an apparatus and method for controlling print ribbon feed in a printing system.

Background of the Invention

In a printing system, such as a document encoding system used by banks and other financial institutions to encode checks and other documents, a conveyor mechanism is provided for moving the documents to be encoded along a predetermined path. A print ribbon with magnetic ink disposed thereon is used to print a selected code on each document. As the documents are moved past a plurality of fixed dies disposed along the conveyor path, a plurality of print hammers are operated in a selected sequence to strike the ribbon, thereby transferring magnetic ink to the documents to effect the desired encoding. The ribbon is moved at approximately the same speed as the documents during the encoding process.

The ribbon is typically comprised of a thin, flexible material having a width on the order of 0.25 inch. The ribbon is wound on a rotatable supply reel and is collected after use by a rotatable take-up reel. A rotatable capstan is disposed between the supply and take-up reels for moving the ribbon between the supply and take-up reels. The movement of the capstan is controlled by the movement of documents along the conveyer path.

A first vacuum column is disposed between the supply reel and the capstan and a second vacuum column is disposed between the capstan and the take-up reel. The vacuum columns provide a buffer for the ribbon, to prevent damage thereto during capstan start-up and to allow the capstan to reverse the ribbon short distances (i.e., approximately 4.5 inches or less) without having to move either the supply or take-up reel. For proper operation, each vacuum column should be maintained approximately one-half full of ribbon.

In order to maintain the proper amount of ribbon in each vacuum column, the movements of the supply and take-up reels must be carefully controlled. Separate drive motors are typically provided for the supply and take-up reels so that the reels can be moved independently. The rotational movement of each reel is governed by the rotational movement of the capstan and the amount of ribbon in the corresponding vacuum column. The amount of ribbon wound on each reel determines the rotational speed of the corresponding reel for a particular capstan speed. The capstan has a fixed diameter (e.g., 1.5 inches) and is rotated at a constant speed during the encoding operation, so that the portion of the ribbon which is being used for document encoding will be moved by the capstan at a constant linear speed (e.g., approximately 40 inches per second).

If the supply reel has a relatively full supply of ribbon, the reel will not have to rotate as fast to keep up with the movement of the capstan as it would if the supply reel were near empty because the rate at which the ribbon is removed from the supply reel is greater when the reel is near full than when the reel is near empty for a given rotational speed. As the ribbon supply is used, the supply reel will become less full, so that the reel will have to rotate faster to keep up with the movement of the capstan. By the same token, the take-up reel will have to rotate faster to retrieve the used ribbon being moved by the capstan when the take-up reel is near empty than when the take-up reel is relatively full. As the take-up reel becomes filled with used ribbon, its rotational speed will be reduced accordingly.

Proper control of the supply and take-up reels requires that the amount of ribbon wound on both the supply and take-up reels be continually monitored. Furthermore, it is imperative that new ribbon be added to the supply reel before the supply reel becomes completely empty, to prevent degradation of print quality, which may occur if the supply reel is completely emptied. It is therefore necessary to be able to detect a low ribbon supply condition before the supply reel is completely empty.

Description of the Prior Art

Various apparatus and methods are known in the art for monitoring the quantity of ribbon wound on both the supply and take-up reels and for controlling the movements of the reels accordingly. One such apparatus, as disclosed in IBM Technical Disclosure Bulletin, Volume 25, No. 11 B (April, 1983), measures the inertia of a wound tape reel by counting the number of rotations thereof resulting from the application of a known amount of rotational torque. The inertia of the reel is related to the quantity of tape wound thereon. This type of apparatus is suitable for initially determining the quantity of tape wound on a reel, but is not suitable for continually monitoring the quantity tape or ribbon remaining on the reel during operation.

Other types of apparatus use external sensors, such as tachometers, to keep track of the number of rotations of a wound tape reel. The number of rotations is compared to a reference value, such as longitudinal tape speed, for controlling the rotational speed of the reel. The amount of tape wound on the reel is a function of the relationship between the longitudinal speed of the tape and the speed of rotation of the reel. Apparatus of this type are disclosed in U.S. Pat. Nos. 3,663,806; 3,834,648; 4,159,572; and 4,581,514, and in Japanese Patents Nos. JA 61-199972 and 61-63473. External sensors, such as tachometers and counters, and logic circuitry are required to continually monitor the amount of wound tape and to control rotational movement of the reel accordingly, which increases the complexity and expense of the system.

Another disadvantage of prior art tape/ribbon feed control apparatus is that a single ramp table is typically used to accelerate the reel to and decelerate the reel from the a desired rotational speed, irrespective of whether the reel is full or near empty. The ramp table defines acceleration/deceleration parameters, based on the specifications of the motor which is used to drive the reel. Because the amount of tape or ribbon wound on the reel is not taken into account in determining acceleration/deceleration parameters, the drive motors used are more powerful and expensive than would otherwise be required.

Objects of the Invention

It is therefore the principal object of the present invention to provide an improved apparatus for controlling ribbon feed in a printing system.

Another object of the invention is to provide an improved apparatus and method for monitoring the quantity of ribbon wound on supply and take-up reels in a printing system.

Yet another object of the invention is to provide an apparatus and method for controlling ribbon feed in a printing system by moving supply and take-up reels in discrete rotational steps.

Still another object of the invention is to provide an apparatus and method for controlling ribbon feed in a printing system in which a plurality of ramp tables are provided for defining speed and acceleration parameters of the reels as a function of the quantity of ribbon wound thereon.

A further object of the invention is to provide an improved apparatus and method for detecting a low ribbon supply condition in a printing system.

Summary of the Invention

These and other objects are accomplished in accordance with the present invention wherein an apparatus is provided for controlling ribbon feed in a printing system in which ribbon is wound on first and second rotatable reels and a rotatable capstan is provided for moving the ribbon between the first and second reels, such that ribbon is supplied from the first reel and is collected after use by the second reel. The apparatus includes processing means for controlling rotational movements of the reels and capstan and for determining the quantity of ribbon wound on each of the reels based on a known diameter of the capstan and the relationship between the rotational movement of the corresponding reel and the rotational movement of the capstan during a particular time period. Memory means is provided for storing a plurality of sets of parameters for controlling the rotation of the reels. Each set of parameters includes a speed parameter defining a discrete rotational speed and an acceleration parameter for ramping up to and down from the corresponding rotational speed for a discrete range of ribbon quantities. The processing means selects a particular set of parameters corresponding to the quantity of ribbon on each reel and controls the movement of the corresponding reel accordingly.

In accordance with one feature of the invention, first, second and third stepper motors are provided for rotating the respective first and second reels and the capstan in discrete steps, each of which represents a predetermined angular increment of rotation. The processing means counts the number of steps moved by each of the reels and by the capstan during a particular time period and compares the number of steps moved by each reel to a predetermined reference value, based on the number of capstan steps, to determine the applicable discrete range of ribbon quantities. The number of steps moved by each reel is compared with the predetermined reference value at predetermined intervals, each interval representing a predetermined number of capstan steps. In effect, the processing means determines the approximate diameter of ribbon wound on each reel, based on the known diameter of the capstan and on a ratio between the number of steps moved by the capstan and the number of steps moved by the corresponding reel during the particular time period.

In accordance with another feature of the invention, the processing means disables the rotational movement of the first reel when the ribbon diameter on the first reel reaches a predetermined minimum value, whereby a low ribbon condition is detected. The ribbon supply can then be replenished before it completely runs out to maintain consistent print quality.

In the preferred embodiment, each set of parameters defines a discrete ramp table for controlling the acceleration of a corresponding reel up to and the deceleration of the corresponding reel down from the discrete rotational speed. The speed parameter of each ramp table is based on the minimum ribbon diameter in the corresponding discrete range of ribbon diameters for that particular table and the time parameter is based on the maximum ribbon diameter in the corresponding discrete range of ribbon diameters. The rotational speed is therefore based on the maximum rotational speed required for the corresponding discrete range of ribbon diameters (minimum ribbon quantity) and the acceleration parameters are based on maximum acceleration/deceleration required for the corresponding discrete range of ribbon diameters (maximum ribbon quantity).

Brief Description of the Drawings

Other objects and advantages of the invention will be apparent from the detailed description and claims when read in conjunction with the accompanying drawings, wherein:

Detailed Description of the Preferred Embodiment

In the description which follows, like parts are marked throughout the specification and drawings, respectively. The drawings are not necessarily to scale and in some instances proportions have been exaggerated in order to more clearly depict certain features of the invention.

Figure 1:
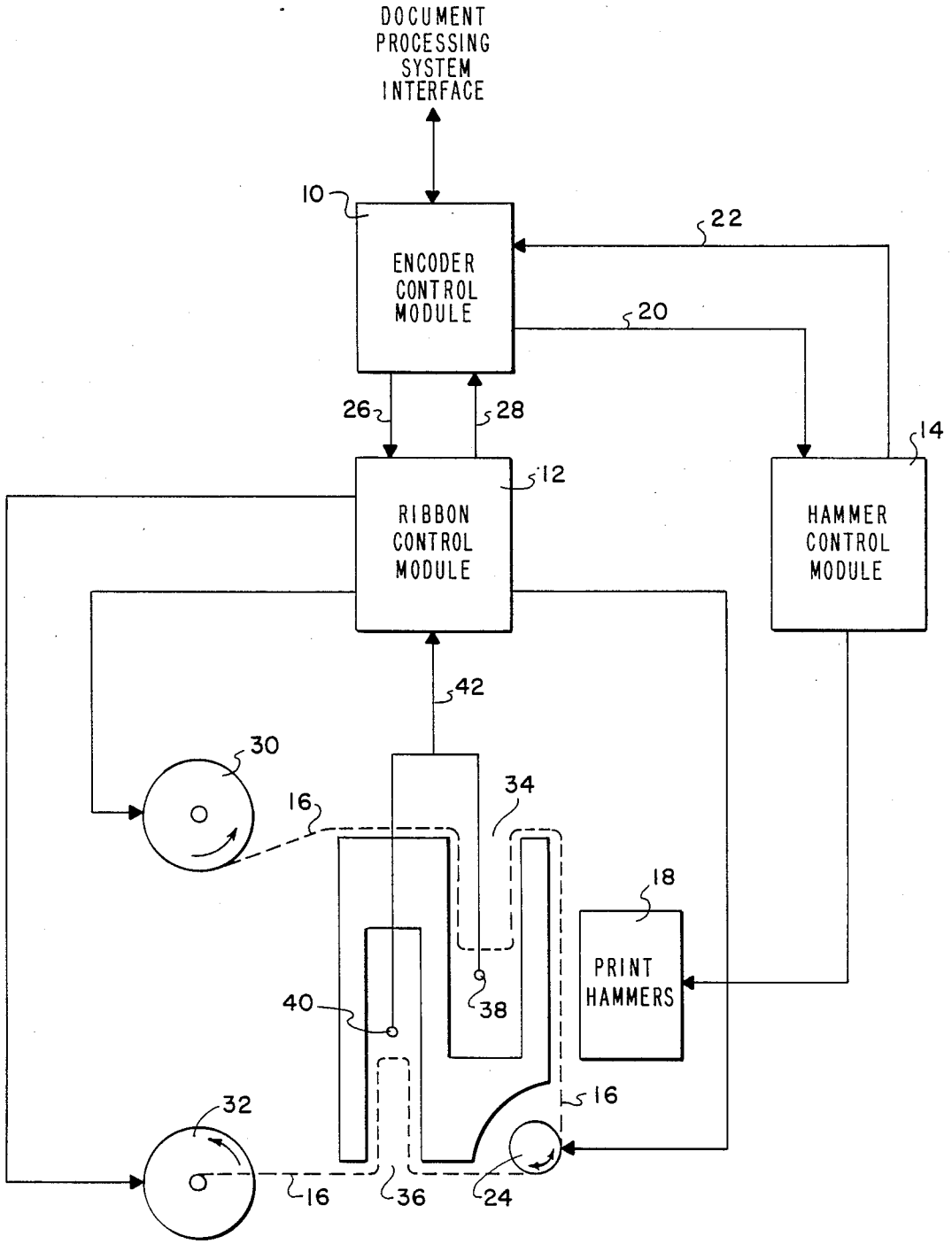
FIG. 1 is a schematic depicting a document encoding apparatus.

Referring to FIG. 1, a document processing system includes apparatus for encoding documents fed into the system. The apparatus includes an encoder control module 10, a ribbon control module 12 and a hammer control module 14. Ribbon control module 12 and hammer control module 14 are preferably microprocessors of the 8088 type, manufactured and sold by Intel Corporation, and encoder control module 10 is preferably a microprocessor of the 80188 type, also manufactured and sold by Intel Corporation. Ribbon control module 12 controls the operation of a print ribbon 16, which has magnetic ink disposed thereon, and hammer control module 14 controls a plurality of print hammers 18. Documents (not shown) are transported between print ribbon 16 and hammers 18. A plurality of fixed dies (not shown) are positioned, such that ribbon 16 is interposed between the documents and the fixed dies. As the documents are transported past the dies, hammers 18 are operated in a selected sequence to strike print ribbon 16, thereby transferring magnetic ink from print ribbon 16 to the documents, to provide the desired encoding. Print ribbon 16 is typically transported at substantially the same velocity as the documents during the encoding process. The encoding system described above is particularly well-suited for encoding bank checks and other financial documents. Each check is typically encoded to identify the bank, the depositor's account and the amount of the check.

Encoder module 10 sends the data to be encoded on the documents to hammer control module 14 via conductor 20 and receives information regarding the current status of hammers 18 from hammer control module 14 via conductor 22. Ribbon control module 12 also controls the movement of a rotatable drive capstan 24, which drives print ribbon 16 during the encoding process. Encoder control module 10 transmits control signals for starting and stopping capstan 24 to ribbon control module 12, via conductor 26 and receives information on the status of print ribbon 16 from ribbon control module 12, via conductor 28.

Capstan 24 is preferably moved in discrete rotational steps by means of a stepper motor (not shown). Each step represents a predetermined angular increment of a complete revolution (e.g., 200 steps per complete revolution). Ribbon control module 12 includes a random access memory in which a plurality of ramp tables are stored. One of the ramp tables is dedicated to controlling the movements of the capstan stepper motor to ramp capstan 24 up to and down from a predetermined rotational speed, to move print ribbon 16 at a desired linear speed. The other ramp tables are used to control the movements of the supply and take-up stepper motors, as will be described in greater detail hereinafter. The rotational speed of capstan 24 will depend upon its diameter, as well as the desired linear speed of ribbon 16. For example, the rotational speed of capstan 24 may be selected to move print ribbon 16 at a linear speed of approximately 40 inches per second.

Print ribbon 16 is wound on a supply reel 30 and ribbon 16 is collected after use on a take-up reel 32. Both supply and take-up reels 30 and 32 are rotatably driven by respective stepper motors (not shown), whereby reels 30 and 32 are moved in the same discrete rotational steps as the stepper motor which drives the capstan. Ribbon control module 12 generates first, second and third sets of electrical pulses for controlling the respective stepper motors. Each pulse moves the corresponding motor one step. The pulse frequency or "duty cycle" determines the rotational speed of the motor and hence the rotational speed of the driven member.

First and second vacuum columns 34 and 36 are interposed between reels 30 and 32 to provide a buffer for ribbon 16 to be moved relatively short distances in either direction without the need to rotate either reel 30 or 32. Vacuum sensors 38 and 40 are medially positioned in respective vacuum columns 34 and 36 for detecting the presence of ribbon 16 in the respective vacuum columns 34 and 36. When a particular vacuum column 34 or 36 is more than half-full of ribbon 16, the vacuum in the column will be disturbed by the presence of the ribbon 16, which will be detected by sensors 38 and 40. Ribbon 16 is fed from supply reel 30 into supply vacuum column 34 and reverses directions therein, as indicated by the dashed lines in vacuum column 34. Ribbon 16 is evacuated from vacuum column 34 by the clockwise movement of capstan 24. Similarly, the clockwise movement of capstan 24 will feed ribbon 16 into take-up vacuum column 36, wherein ribbon 16 reverses directions, as indicated by the dashed lines in vacuum column 36. Ribbon 16 is evacuated from vacuum 36 by the counterclockwise rotation of reel 32, to remove excess ribbon 16 from vacuum column 36. Ribbon control module 12 is responsive to respective output signals from sensors 38 and 40, via electrical conductor 42, for controlling the movements of reels 30 and 32 to maintain columns 34 and 36 approximately one-half full of ribbon 16.

Figure 2:
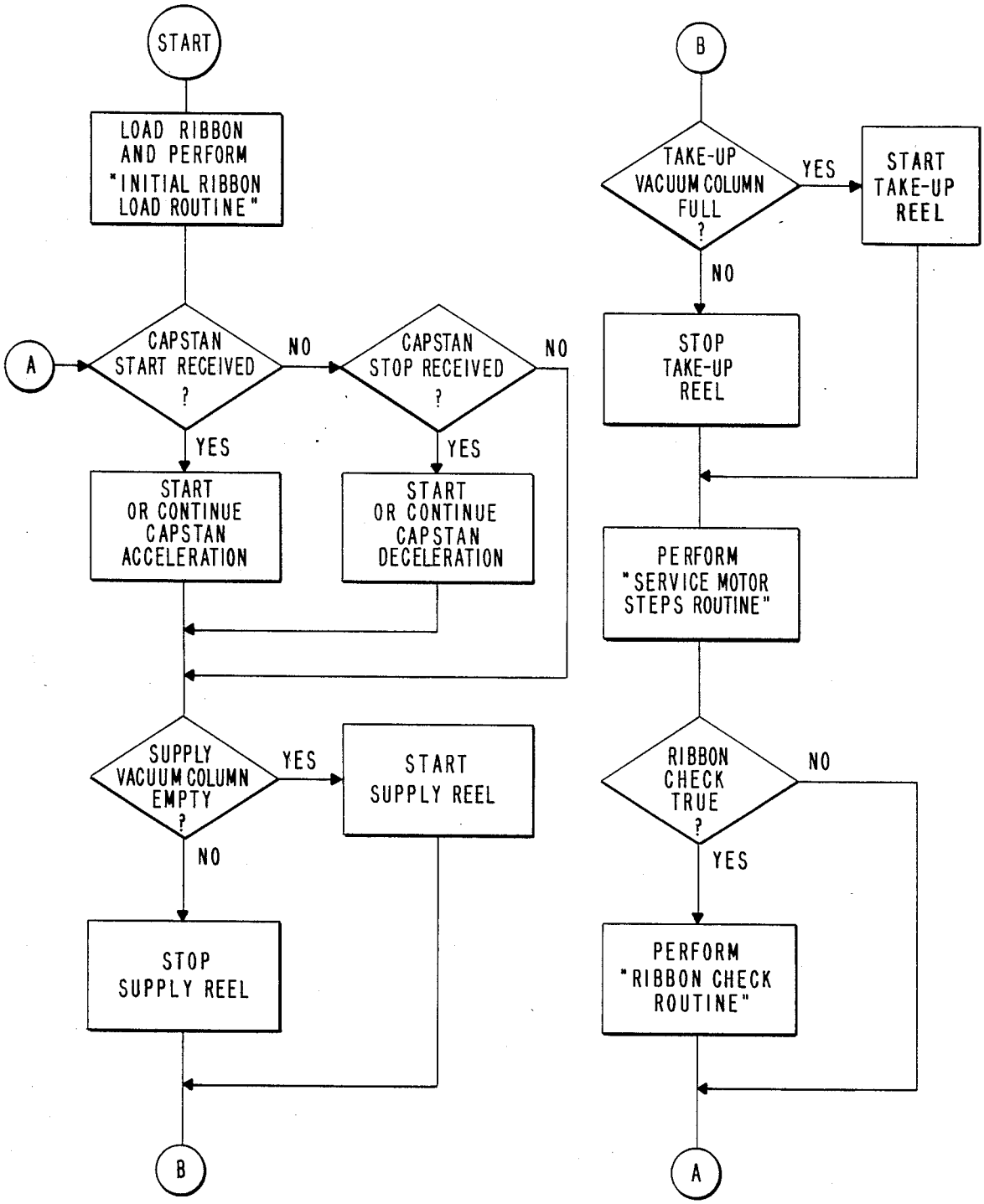
FIGS. 2–5 are respective flow diagrams, depicting the sequence of operation of a print ribbon control apparatus, according to the present invention.

Ribbon control module 12 has a read-only memory in which a set of program instructions is stored for controlling the operation of capstan 24 and reels 30 and 32. Referring to FIG. 2, the sequence of operation of the ribbon feed control program is depicted. The print ribbon is loaded on the supply and take-up reels and into the vacuum columns and an "Initial Ribbon Load Routine" is performed, as depicted in FIG. 3, to determine the initial quantity of ribbon loaded onto both the supply and take-up reels.

Figure 3:
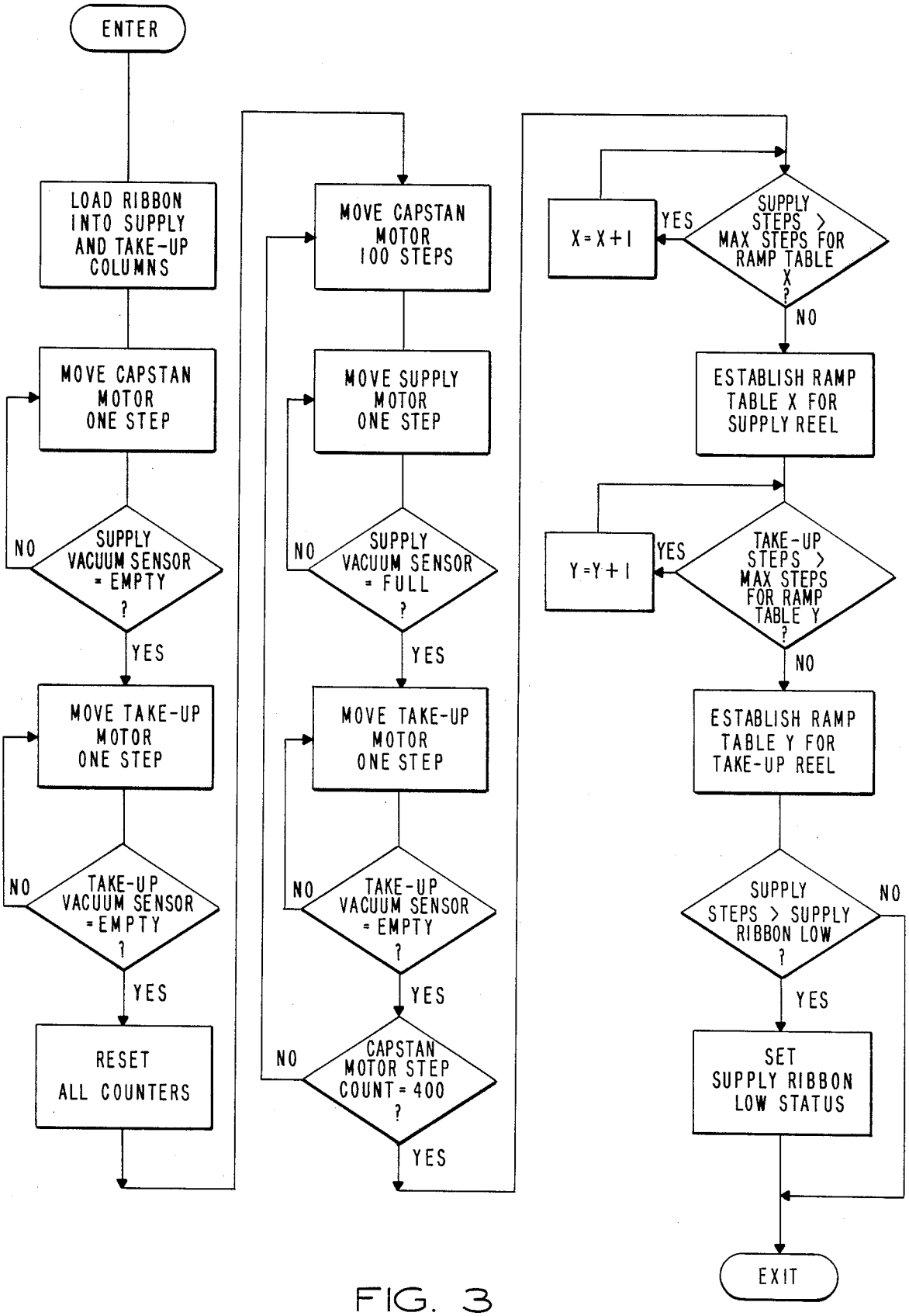

Referring specifically to FIG. 3, after the ribbon is loaded into the vacuum columns, the capstan stepper motor is advanced one step, in order to move some of the ribbon out of the supply vacuum column. The capstan motor will be moved in discrete steps until the supply vacuum column sensor indicates "EMPTY", which means that the supply vacuum column is approximately one-half full of ribbon. After the supply vacuum column sensor indicates "EMPTY", the take-up reel stepper motor will be moved in discrete steps until the take-up vacuum column sensor also indicates "EMPTY" (i.e., approximately one-half full of ribbon). By moving the capstan motor and the take-up reel motor one step at a time, the quantity of ribbon present in both the supply and take-up vacuum columns can be adjusted with relative precision, so that each vacuum column is approximately one-half full. At this juncture, all step counters are reset to zero and the program will begin keeping track of the number of steps moved by the capstan motor and by the supply and take-up reel motors to determine the initial quantity of ribbon wound on each of the reels.

The initial quantity of ribbon wound on each reel is determined by comparing the number of steps moved by both the supply and take-up reel motors to the number of steps moved by the capstan during the same time interval. Because the diameter of the capstan is known (e.g., approximately 1.5 inches), the approximate diameter of ribbon wound on each reel can be determined, within a desired range of diameters. One skilled in the art will appreciate that for a particular rotational speed, the rate at which ribbon is payed out from (in the case of the supply reel) or taken up onto (in the case of the take-up reel) a reel will be greater when the reel is relatively full of ribbon (maximum ribbon diameter) than when the reel is near empty (minimum ribbon diameter). Therefore, the number of steps moved by the reel, as compared to the number of steps moved by the capstan, during a given time period provides a relatively accurate indicator of the approximate diameter of ribbon wound on the corresponding reel.

To determine the approximate diameter of ribbon wound on each reel, the capstan motor is moved 100 steps at a time. After each 100 step movement of the capstan motor, the supply motor is moved in one step increments until the supply vacuum column sensor indicates "FULL" (i.e., the supply vacuum column is approximately one-half full). The take-up reel motor is then moved in one step increments until the take-up vacuum column sensor indicates "EMPTY" (i.e., the take-up vacuum column is approximately one-half full). This process is iteratively repeated until the capstan motor has been moved a total of 400 steps.

After the capstan motor has been moved a total of 400 steps, an initial ramp table is established for the supply reel by comparing the number of steps moved by the supply motor to a predetermined reference value representing a maximum number of steps for a particular reel size X (i.e., a particular discrete range of ribbon diameters). The following Table I depicts a predetermined number of reference steps for a corresponding ribbon diameter, based on a movement of 400 capstan steps.

TABLE I

| Ribbon Diameter (in.) | Ribbon Circumference (in.) | No. of Steps/ 400 Capstan Steps |
|---|---|---|
| 1.5 | 4.71 | 400 |
| 2.5 | 7.85 | 240 |
| 3.5 | 10.99 | 171.4 |
| 5.0 | 15.7 | 120 |
| 6.5 | 20.41 | 92.32 |

The following Table II establishes a plurality of ramp tables based on a corresponding plurality of discrete ranges of ribbon diameters:

TABLE II

| Ramp Table Number | Maximum Diameter (in.) | Minimum Diameter (in.) |
|---|---|---|
| 1 | 6.5 | 5.0 |
| 2 | 5.0 | 3.5 |
| 3 | 3.5 | 2.5 |
| 4 | 2.5 | 1.5 |

The program will begin by comparing the number of steps moved by the supply motor (supply steps) to the maximum number of steps associated with Ramp Table 1. The maximum number of steps for Ramp Table 1 is 120, which corresponds to the minimum ribbon diameter in the particular range of ribbon diameters associated with Ramp Table 1 (i.e., 5.0 inches). Therefore, if the number of supply steps is less than or equal to 120, the diameter of ribbon wound on the supply reel will be greater than or equal to 5.0 inches, which corresponds to the first ramp table. If, however, the number of supply steps is greater than 120, the ribbon diameter on the supply reel will be less than 5.0 inches and the program will compare the number of supply steps to the maximum number of steps for Ramp Table 2, which corresponds to the minimum diameter of 3.5 inches. According to Table I, the maximum number of steps for Ramp Table 2 is 171.4. The program will continue the comparison until the number of supply steps is less than or equal to the maximum number of steps for a particular ramp table, at which point that particular ramp table will be established for the supply reel.

After the initial ramp table X is established for the supply reel, an initial ramp table Y is established for the take-up reel in substantially the same manner as described above with reference to the supply reel, using the same four ramp tables, as shown in Table II. After the initial ramp tables are established for the supply and take-up reels, the number of supply steps is compared to a predetermined value representing a low ribbon supply condition. For example, a low ribbon supply condition may be indicated when the diameter of ribbon wound on the supply reel drops to 1.6 inches. If the diameter of the capstan is 1.5 inches, the number of supply steps corresponding to a low ribbon supply condition will be $(1.5/1.6)\times 400$, which is 375 steps. Therefore, if the number of supply steps is greater than 375, the diameter of ribbon on the supply reel will be less than 1.6 inches and a low ribbon condition will be indicated. If the number of supply steps is less than or equal to 375 there is sufficient ribbon available to begin operation and the program will return to the routine depicted in FIG. 2.

Referring again to FIG. 2, the capstan motor is controlled by the ribbon control module in response to control signals transmitted from the encoder control module. The ribbon control module includes a capstan ramp table for accelerating the capstan up to and decelerating it from the desired rotational speed (e.g., 40 inches per second). Only one ramp table is used for the capstan because the capstan is driven at a constant rotational speed when the capstan is operating. If the ribbon control module receives a "CAPSTAN START" control signal from the encoder control module, the capstan will be accelerated according to the capstan ramp table up to the desired rotational speed; whereas, if a "CAPSTAN STOP" control signal is received by the ribbon control module, the capstan will be decelerated down from the desired rotational speed, in accordance with the capstan ramp table.

The program will continually monitor the condition of both the supply and take-up vacuum columns. If the supply vacuum column indicates "EMPTY", the supply reel motor will be operated to rotate the supply reel, thereby supplying print ribbon to the supply vacuum column until the supply vacuum column sensor no longer indicates "EMPTY". By the same token, the take-up motor will be operated to move ribbon out of the take-up vacuum column when the take-up vacuum column sensor indicates "FULL" and will continue to do so until the take-up vacuum column sensor no longer indicates "FULL". The particular ramp table X established for the supply reel and the particular ramp table Y established for the take-up reel, pursuant to the initial ribbon load routine, as described above, are used to control the movements of the corresponding stepper motors.

The particular ramp tables X and Y which are used to control the movements of the supply and take-up motors include respective speed parameters defining respective rotational speeds and respective acceleration parameters for accelerating the corresponding reels up to and decelerating them down from the respective rotational speeds. Each speed parameter is based on the minimum ribbon diameter in the corresponding discrete range of ribbon diameters associated with the particular ramp table and each acceleration parameter is based on the maximum ribbon diameter in the corresponding discrete range of ribbon diameters, such that the reel will be rotated at the maximum speed required for the corresponding discrete range of ribbon diameters and will be ramped up to and down from the maximum speed for the corresponding discrete range of ribbon diameters within a predetermined time interval. The discrete rotational speed associated with each ramp table is selected to provide a minimum linear speed of approximately 45 inches per second, so that the ribbon can be moved from the supply reel and collected by the take-up reel at a speed which is slightly greater than a linear speed imparted to the ribbon by the rotation of the capstan.

The rotational speed is established according to the following formula:

$$\text{SPEED (steps/second)} = \text{Linear Speed (inches/second)} \times \text{steps per revolution/minimum ribbon diameter} \times \pi \quad (1)$$

If the desired linear speed is 45 inches per second and the number of steps per revolution is 200, formula (1) becomes:

$$\text{SPEED} = 900/(\pi \times \text{minimum ribbon diameter})$$

The average acceleration (ACCEL) is the rotational speed (SPEED), divided by the total time (TIME) required to ramp up to and down from the rotation speed. The time required to reach the discrete rotational speed is a function of the number of steps in the corresponding ramp table and is typically a function of the specifications of the stepper motor. The total number of steps in the ramp table (N) is expressed by the following formula:

$$N=(\text{SPEED})^2/(2\times\text{ACCEL})$$

The acceleration of the corresponding stepper motor is not constant, but rather is linear, such that the time required for each succeeding step in the ramp table will be less than the immediately preceding step. The time, expressed in milliseconds, required to each step in the ramp table is calculated as follows:

$$T_{(i)}=1{,}000/(2\times\text{ACCEL}\times(i))$$

where (i) is the particular step number 1 through N.

The total ramp time (RT) is the sum of the individual times of all of the steps in the ramp table, expressed as follows:

$$RT=\sum_{(i)=1}^{N} T_{(i)} \tag{4}$$

The desired total ramp time (RT) for all ribbon diameters is approximately 80 milliseconds. To achieve this result, the value of "TIME" is varied to adjust the average acceleration (ACCEL), such that Formula (4) will yield a value of approximately 80 milliseconds.

Figure 4:
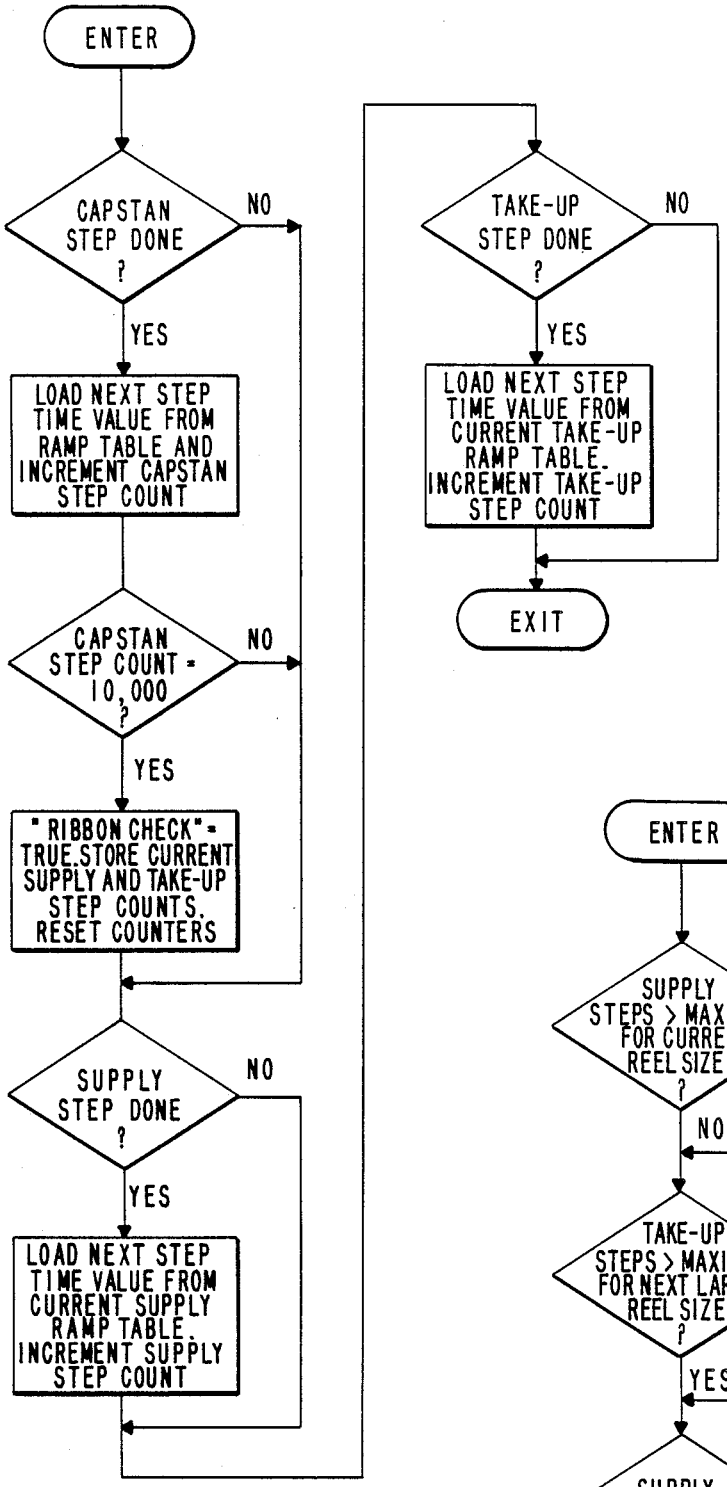

Referring again to FIG. 2, a "Service Motor Steps Routine" will be performed according to the sequence set forth in FIG. 4. Referring to FIG. 4, the movements of the three stepper motors which control the capstan, the supply reel and the take-up reel, respectively, are continually monitored. As previously mentioned, each step of the corresponding ramp table has a discrete time parameter $T_i$. When the program detects that a particular step has been completed, it will load the time parameter for the next step from the ramp table and increment the corresponding step count. This routine is performed for all three of the stepper motors.

When the capstan step count reaches 10,000 a "Ribbon Check" Flag will indicate that the respective quantities of ribbon wound on the supply and take-up reels are to be checked. The number of steps moved by the supply and take-up stepper motors during the time that the capstan stepper motor was moved 10,000 steps are stored in memory and the respective counters are reset.

Figure 5:
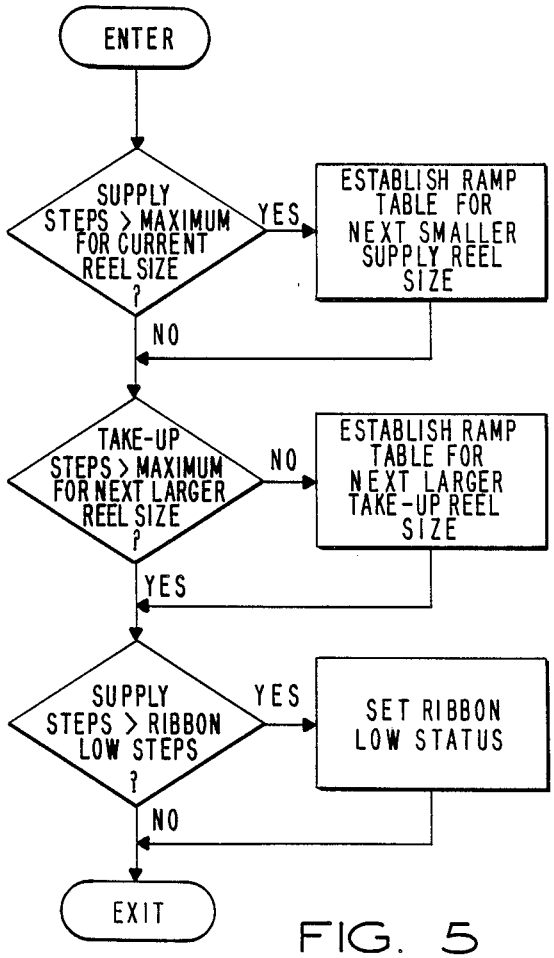

Referring again to FIG. 2, if a "Ribbon Check" Flag indicates TRUE, the program will perform the Ribbon Check Routine set forth in FIG. 5. Referring to FIG. 5, the number of steps moved by both the supply and take-up motors are compared with predetermined reference values corresponding to respective predetermined ribbon diameters, based on 10,000 steps moved by the capstan motor. Table III shows the predetermined reference values for the various ribbon diameters.

TABLE III

| Ribbon Diameter (in.) | Ribbon Circumference (in.) | No. of Steps/ 10,000 Capstan Steps |
|---|---|---|
| 1.5 | 4.71 | 10,000 |
| 2.5 | 7.85 | 6,000 |
| 3.5 | 10.99 | 4,285 |
| 5.0 | 15.7 | 3,000 |
| 6.5 | 20.41 | 2,308 |

If the number of supply steps is greater than the maximum number of steps allowed for the current ramp table (i.e., the number of steps corresponding to the minimum ribbon diameter for that ramp table), the ramp table for the next smaller range of ribbon diameters will be selected. For example, if the current ramp table corresponds to ramp table 1 (ribbon diameter 5.0–6.5 inches), the next smaller ramp table will be ramp table 2, which corresponds to a range of ribbon diameters between 3.5 inches and 5.0 inches. If, however, the number of supply steps is less than or equal to the maximum number of steps allowed for the current ramp table, the current ramp table will continue to be used to control the supply stepper motor, at least until the next time that the ribbon supply is checked.

The number of steps moved by the take-up stepper motor will be compared to the maximum number of steps allowable for the next larger range of ribbon diameters. If the number of take-up steps is less than or equal to the maximum number of steps allowable for the next larger range of ribbon diameters, then the ramp table for the next larger range of ribbon diameters will be established. If the number of take-up steps is greater than the maximum number allowable for the next larger reel size, the current ramp table will remain in effect for the take-up reel, at least until the next time that the ribbon check routine is performed. The supply reel will also be checked for a low ribbon condition. If the low ribbon condition corresponds to a ribbon diameter of 1.6 inches on the supply reel, as previously described, a low ribbon condition will be indicated when the number of supply steps exceeds the corresponding reference number of steps for a ribbon diameter of 1.6 inches. For 10,000 capstan steps, the reference number would be 9,375, so that a low ribbon condition would be indicated when the number of supply steps exceeds 9,375. After the "Ribbon Check Routine" is performed, the program will return to the beginning, as indicated at A, whereupon the entire sequence, as described above, will be repeated.

One skilled in the art will appreciate that the movements of the supply and take-up reels are controlled to maintain the supply and take-up vacuum columns approximately one-half full at all times. The movements of the supply and take-up reels will be responsive not only to the output signals of the respective supply and take-up vacuum column sensors, but also to the movements of the capstan. By providing a plurality of ramp tables for controlling the movements of the supply and take-up reels, the operation of the stepper motors is more finely tuned to the prevailing ribbon conditions on the reels, thereby enabling the use of smaller, less powerful and less expensive stepper motors. Additional ramp tables can be provided for even more accurate determination of ribbon quantities and better control of ribbon feed. External sensors for determining ribbon quantities and electronic hardware associated therewith are not required. The elimination of external sensors, such as optical sensors, also enables different types of ribbon material to be used because the ribbon need not have reflective qualities, which would be required if optical sensors were used.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. Apparatus for controlling ribbon feed in a printing system having ribbon wound on first and second rotatable reels and a rotatable capstan for moving the ribbon between said first and second reels, such that ribbon is supplied from said first reel and is taken up by said second reel, said apparatus comprising:

processing means for controlling rotational movements of said reels and said capstan and for determining the quantity of ribbon wound on each of said reels according to a known diameter of the capstan and a relationship between the rotational movement of the corresponding reel and the rotational movement of the capstan during a particular time period; and memory means for storing a plurality of sets of parameters for controlling the rotation of said reels, each set of parameters including a speed parameter defining a discrete rotational speed and an acceleration parameter for ramping up to and down from the corresponding rotational speed for a discrete range of ribbon quantities, said processing means for selecting a particular set of parameters corresponding to the quantity of ribbon on each reel and for controlling the movement of the corresponding reel in accordance therewith.

2. The apparatus of claim 1 wherein said system includes first and second stepper motors for rotating the respective first and second reels in discrete steps, each of said steps representing a predetermined angular increment of rotation, said system further including a third stepper motor for rotating said capstan in said discrete steps, said processing means for determining the quantity of ribbon on each reel by counting the number of steps moved by each reel and by the capstan during the particular time period and by comparing the number of steps moved by each reel to a predetermined reference to determine the particular discrete range of ribbon quantities applicable to each reel.

3. The apparatus of claim 2 wherein the discrete range of ribbon quantities represents a discrete range of diameters of ribbon wound on a corresponding reel, said processing means for comparing the number of steps moved by each reel to at least one of a plurality of reference values representing respective predetermined ribbon diameters, to determine the particular discrete range of ribbon diameters applicable to each reel.

4. The apparatus of claim 3 wherein the discrete range of ribbon diameters is determined for each reel at predetermined intervals, each interval representing a predetermined number of steps moved by the capstan, said processing means for selecting the particular set of parameters for controlling the movement of each reel corresponding to the applicable discrete range of ribbon diameters.

5. The apparatus of claim 3 wherein each of said sets of parameters has a speed parameter which is based on the minimum ribbon diameter in the corresponding discrete range of ribbon diameters and an acceleration parameter defining a predetermined time interval based on the maximum ribbon diameter in the corresponding discrete range of ribbon diameters, such that the corresponding reel is rotated at the maximum speed required and is ramped up to and down from the maximum speed for the corresponding discrete range of ribbon diameters within the predetermined time interval.

6. The apparatus of claim 3 wherein said processing means generates first, second and third sets of electrical pulses for controlling the respective first, second and third stepper motors, each of said pulses for moving the corresponding motors one rotational step, the frequency of the first set of pulses for determining the rotational speed of the first reel and the frequency of the second set of pulses for determining the rotational speed of the second reel.

7. The apparatus of claim 1 wherein said system further includes first and second vacuum chambers through which said ribbon passes as the ribbon is moved from the first reel to the second reel and first and second vacuum sensors medially positioned in the respective first and second chambers for detecting the amount of ribbon present in the respective chambers, said chambers for providing a buffer to allow the ribbon to be moved relatively short distances in either direction without rotating either of the reels, said processing means being responsive to said vacuum sensors for controlling the rotation of the reels to maintain each chamber approximately one-half full of ribbon.

8. The apparatus of claim 1 wherein said processing means is a microprocessor which controls the rotational movements of the reels and capstan in accordance with a set of program instructions stored therein.

9. The apparatus of claim 1 wherein said memory means is a random access memory having a plurality of discrete storage locations, said plurality of sets of parameters being stored in respective ones of said discrete storage locations.

10. The apparatus of claim 9 wherein each set of parameters defines a discrete ramp table for controlling the acceleration of a corresponding reel up to and the deceleration of the corresponding reel down from a predetermined rotational speed.

11. The apparatus of claim 1 wherein said processing means disables the rotational movement of said first reel when the ribbon diameter on the first reel reaches a predetermined minimum value, whereby a low ribbon supply condition is detected.

12. The apparatus of claim 1 wherein the rotational movements of said first and second reels are controlled independently of one another.

13. A method of controlling ribbon feed in a printing system having ribbon wound on first and second rotatable reels and a rotatable capstan for moving the ribbon between said first and second reels, such that ribbon is supplied from said first reel and is taken up by said second reel, said method comprising the steps of:

determining the quantity of ribbon wound on each of said reels based on a known diameter of the capstan and a relationship between the rotational movement of the corresponding reel and the rotational movement of the capstan during a particular time period;

defining a plurality of sets of parameters for controlling the rotation of said reels, each set of parameters including a speed parameter defining a discrete rotational speed and an acceleration parameter for ramping up to and down from the corresponding rotational speed for a discrete range of ribbon quantities;

selecting a particular set of parameters corresponding to the quantity of ribbon on each reel; and controlling the movement of each reel in accordance with the corresponding set of parameters.

14. The method of claim 13 further including the step of disabling the rotational movement of said first reel when the quantity of ribbon on the first reel reaches a predetermined minimum value, whereby a low ribbon supply condition is detected.

15. The method of claim 13 wherein said system includes first and second drive means for rotating the respective first and second reels in discrete steps, each of said steps representing a predetermined angular increment of rotation, said system further including third drive means for rotating said capstan in said discrete steps, said method including the steps of counting the number of steps moved by the reels and by the capstan during the particular time period and comparing the number of steps moved by each reel to a predetermined reference to determine the discrete range of ribbon quantities applicable to each reel.

16. The method of claim 15 wherein the discrete range of ribbon quantities represents a discrete range of diameters of ribbon wound on a corresponding reel, said method including comparing the number of steps moved by each reel to at least one of a plurality of reference values representing respective predetermined ribbon diameters, to determine the particular discrete range of ribbon diameters applicable to each reel.

17. The method of claim 16 further including the steps of determining the discrete range of ribbon diameters for each reel at predetermined intervals, each interval representing a predetermined number of steps moved by the capstan, and selecting the particular set of parameters for controlling the movement of each reel corresponding to the applicable discrete range of ribbon diameters.

18. The method of claim 16 wherein each of said sets of parameters has a speed parameter which is based on the minimum ribbon diameter in the corresponding discrete range of ribbon diameters and an acceleration parameter defining a predetermined time interval based on the maximum ribbon diameter in the corresponding discrete range of ribbon diameters, such that the corresponding reel is rotated at the maximum speed required and is ramped up to and down from the maximum speed for the corresponding discrete range of ribbon diameters within the predetermined time interval.

19. The method of claim 16 wherein the step of controlling the movement of the reels includes generating first, second and third sets of electrical pulses for controlling the respective first, second and third drive means, each of said pulses for moving the corresponding drive means one step, the pulse frequency for determining the rotational speed of the corresponding drive means.

20. The method of claim 13 wherein said system further includes first and second vacuum chambers through which said ribbon passes as the ribbon is moved from the first reel to the second reel and first and second vacuum sensors medially positioned in the respective first and second chambers for detecting the quantity of ribbon present in the respective chambers, said chambers for providing a buffer to allow the ribbon to be moved relatively short distances in either direction without rotating either of the reels, the movements of the reels being responsive to said vacuum sensors to maintain each chamber approximately one-half full of ribbon.

21. The method of claim 13 wherein each set of parameters defines a discrete ramp table for controlling the acceleration of a corresponding reel up to and the deceleration of the corresponding reel down from a predetermined rotational speed.

* * * * *